US007611397B1

(12) United States Patent
Lund et al.

(10) Patent No.: US 7,611,397 B1
(45) Date of Patent: Nov. 3, 2009

(54) SPRING TAIL BOUNCING FIGURE

(75) Inventors: Bruce D. Lund, 551 N. Jackson, River Forest, IL (US) 60305; Krishnan Sriangam, Chicago, IL (US)

(73) Assignee: Bruce D. Lund, River Forest, IL (US)

( * ) Notice: Subject to any disclaimer, the term of this patent is extended or adjusted under 35 U.S.C. 154(b) by 300 days.

(21) Appl. No.: 11/855,878

(22) Filed: Sep. 14, 2007

(51) Int. Cl.
*A63H 3/20* (2006.01)
*A63H 11/06* (2006.01)

(52) U.S. Cl. ..... 446/330; 446/311; 446/199

(58) Field of Classification Search ..... 446/330, 446/311, 199
See application file for complete search history.

(56) References Cited

U.S. PATENT DOCUMENTS 2,776,525 A * 1/1957 Ford ..... 446/199
2,817,925 A * 12/1957 Kelley ..... 446/311
6,402,153 B1 * 6/2002 Stewart ..... 273/317

* cited by examiner

*Primary Examiner*—Gene Kim
*Assistant Examiner*—Michael D Dennis
(74) *Attorney, Agent, or Firm*—Jack Shore; Much Shelist

(57) ABSTRACT

A toy character assembly having a coiled tail spring connected to one of said legs. There is mechanism provided for movably mounting the legs relative to said body portion. A gear train is operated by a motor to move the legs relative to the body portion in a downwardly direction to compress the coiled tail spring and then release the legs and body portion to set up a harmonic motion of the body and spring tail.

12 Claims, 3 Drawing Sheets

44
42
14
22
10
12
18
13
16
22
20
18
Detail A
32
32
33
33
28a
30a
34
36
21
30
28
40
40
26
24
25

SPRING TAIL BOUNCING FIGURE

BACKGROUND OF THE INVENTION

Toy figures have always been popular with children. Wide varieties of figures that walk, dance, cartwheel and speak in response to a child touching or squeezing various parts of the figure have been developed. However while numerous figures with different movements have been available there is always a need for a figure that will move in a new way to serve as a source of enjoyment for young children.

SUMMARY OF THE INVENTION

There is herein described, illustrated and claimed a unique animated plush figure that will bounce on its tail and emit sounds related to the figure's movement. The plush figure includes a body portion to which is connected a curved spring action tail. The figure contains a motor and drive mechanism that serves to move the body of the figure downwardly against the spring tail to compress it and set up forces in the spring tail tending to return the figure to an upper position. In the illustrated embodiment the figure is directly driven downwardly against the spring tail and springs that act in conjunction with the spring tail to move the figure upward when the downward force is released. The repeated action of the motor drive mechanism and the tail results in a bouncing action that is a delight to behold.

The desired action is brought about by a microprocessor motor controller and a drive gear train operated by the motor. The frequency of the bounce action is controlled by the microprocessor motor controller to move the character up and down at a set rate to set up the harmonic oscillation of the relatively large spring tail assembly. There is a power switch for the motor controller located in the figure as for example in a hand and the power for the microprocessor motor controller is supplied by batteries. The microprocessor motor controller could also contain a sound chip for audio prompts for the figure.

The figure bounces straight up and down at the harmonic rate of the spring tail assembly and when the mechanism and the spring move out of synchronization the character bounces to one side. After a predetermined cycling time the motion of the figure will dampen out and return to its upright position until another cycle is activated. The use of the harmonic oscillation of a large spring results in a higher bouncing action than could be accomplished by other means.

Numerous other advantages and features of the invention will become readily apparent from the following detailed description of the invention, from the claims and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
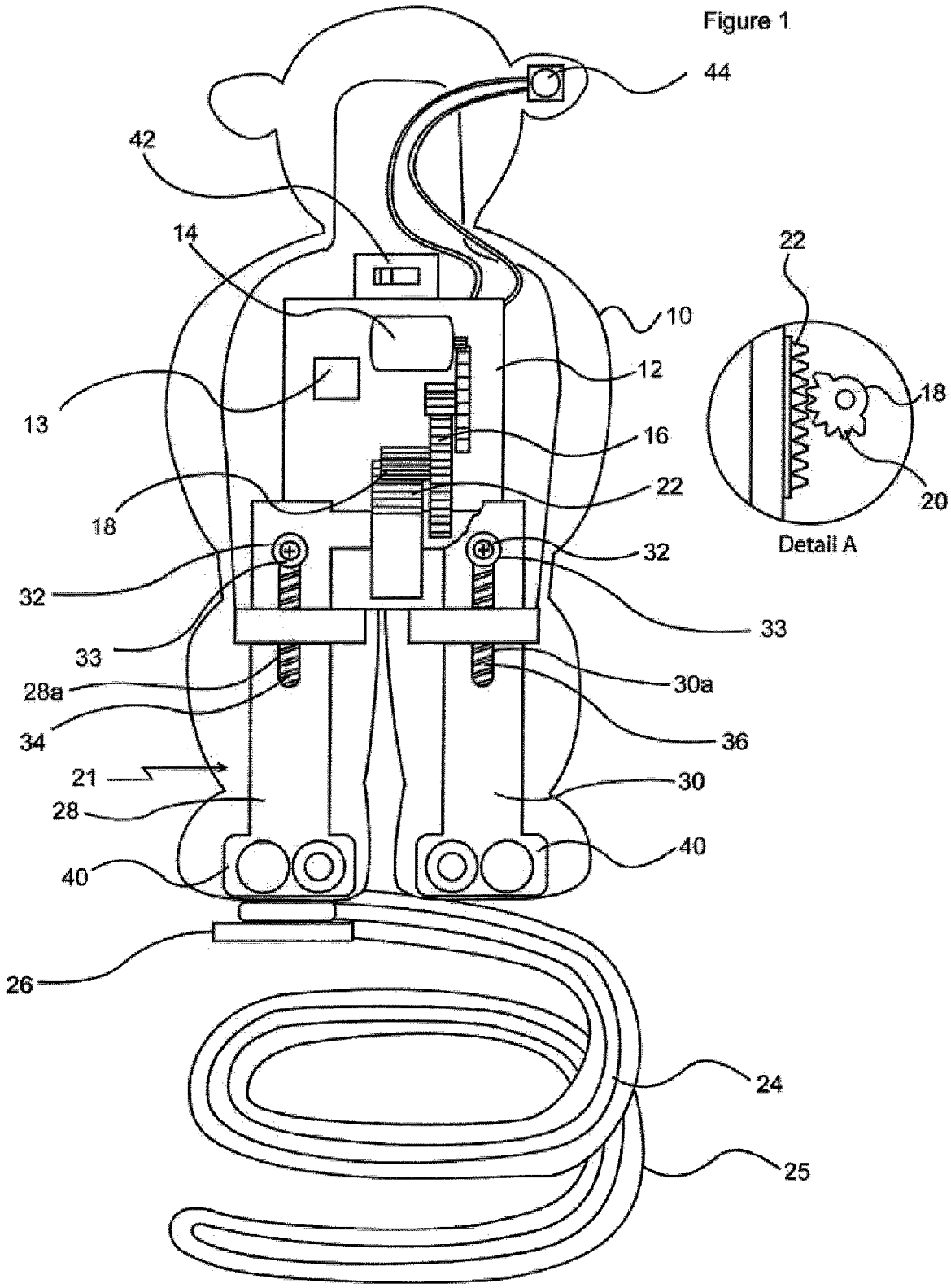
FIG. 1 is a front view of the respective components of the figure to accomplish the movements described hereinbelow.
Figure 2:
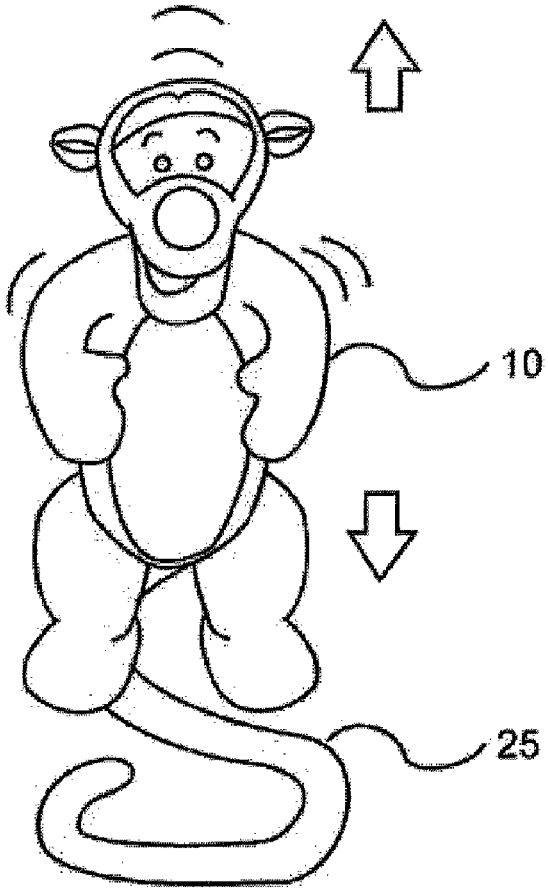
FIG. 2 is a front perspective of the figure being shown in an up-and-down bouncing motion.

Referring to FIG. 1 there is illustrated the character 10 shown in a broken-away view to show the internal components. These consist of a main body portion 12 to which is mounted a microprocessor motor controller 13 that controls the motor 14 that operates a gear train 16. The motor 14 drives the gear train 16 that includes a fixed output pinion 18 that has teeth 20 covering only a portion of its perimeter (see detail A). Secured to a leg assembly 21 is a rack 22. The pinion 18 when rotated and the teeth 20 when engaged drive the rack 22 and leg assembly 21 downwardly to the position shown in FIG. 1. This action compresses the main coiled oscillation spring 24 covered by a plush covering 25 connected to the leg assembly through collar 26. When the teeth 20 are out of engagement with the rack 22, the leg assembly 21 is free to move upwardly a predetermined amount independent of the body portion 12 as described hereinafter. The legs 28, 30 forming part of the leg assembly 21 are connected to each other and are movably connected to the body 12 by screws 32 around which is a collar 33. These screws extend through slots 28A, 30A in the leg members 28, 30 into the body portion 12. This screw and slot arrangement permits movement of the legs relative to the body portion. There are compression springs 34, 36 located in slots 28A, 30A. These springs 34, 36 acting against the screws 32 along with the coiled tail 24 act to move the figure body portion 12 upwardly when the teeth 20 are out of engagement with the rack 22 to obtain the bouncing action described hereinafter. FIG. 1 illustrates the various components in the position wherein the leg assembly 21 has been moved downwardly to its lowest position in engagement with the screws 32 and the tail spring 24 and springs 34, 36 under compression.

Figure 4:
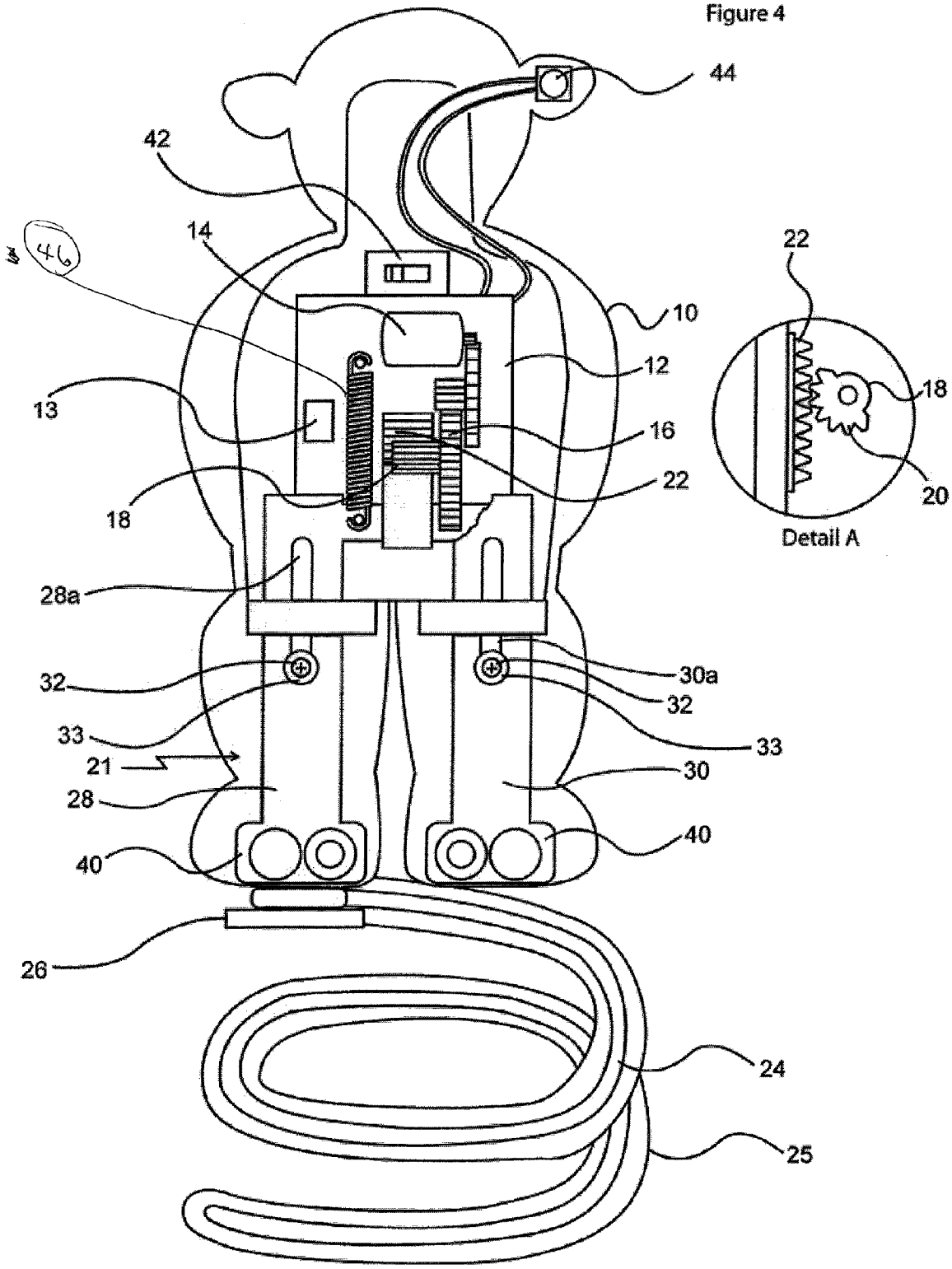
FIG. 4 is a front view of a second embodiment showing the various components to accomplish the desired action.

In the second embodiment shown in FIG. 4 the compression spring 34, 36 have been replaced with the extension spring connected between the body portion 12 and the leg assembly 21.

Initially, the motor 14 operates a microprocessor motor controller 13 to regulate the frequency of the bouncing action of the figure. The motor controller 13 receives power from the batteries 40 as controlled by the power switch 42. The microprocessor 13 may also contain sound chips (not shown) for audio prompts.

The character is activated by means of a selector switch 44 that is shown as being located in the ear 46 but other locations such as the hand or top of the head may be used.

METHOD OF OPERATION

We now return to the gear train 16, pinion 18, and rack 22 mechanism that function to set up the bouncing action. When the motor controller 13 actuates the motor 14, the gear train 16 is moved to rotate the drive pinion 18 in engagement with the rack 22. The pinion teeth 20 extend around approximately 180° of the circumference of the drive pinion. Thus during the 180° movement with the teeth in engagement with the rack (see Detail A), the rack 22 and associated leg assembly 21 are moved downwardly, and springs 34, 36 are compressed to the position shown in FIG. 1. When the pinion 18 moves out of engagement with the rack 22, the compressed springs 34, 36 in the slots 28A, 30A initially move the leg assembly 21 and then the body portion 12 upwardly which action imposes inertial forces in the spring tail 24 to bounce the character straight up and down at the harmonic rate of the spring tail 24.

Figure 3:
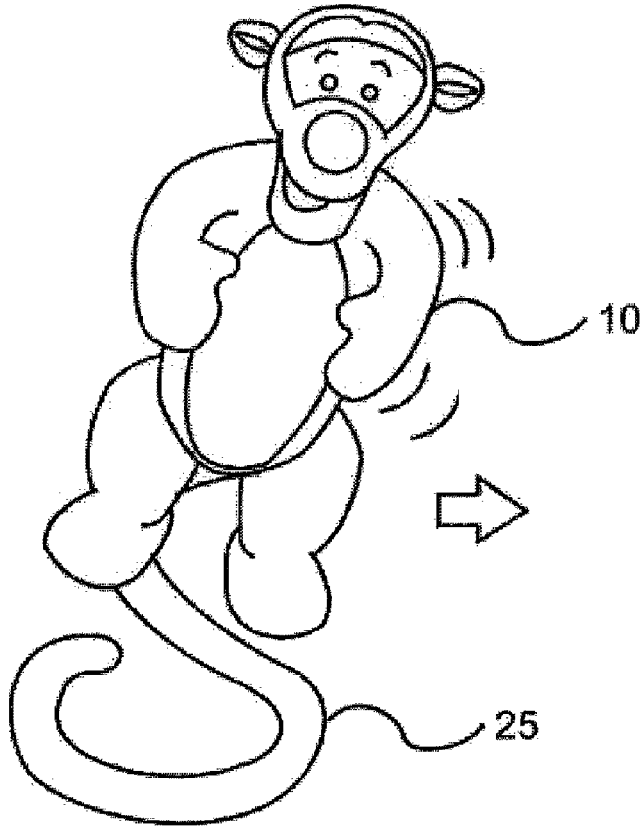
FIG. 3 is a front perspective view similar to FIG. 2 in which the figure is bouncing to one side as the mechanism and spring move out of synchronization.

The method of operation of the embodiment shown in FIG. 4 is similar to that of FIG. 1 but the compression springs 34, 36 have been replaced with the extension spring 46 which is elongated when the leg assembly is moved downwardly. Thus when the pinion 18 moves out of engagement with the rack 22, the extension spring 46 initially moves the leg assembly 21 and then the body portion 12 upwardly. This action imposes inertial forces in the tail spring 24 to bounce the character straight up and down at the harmonic rate of the spring tail 24. When the positive drive mechanism and the spring tail 24 move out of synchronization the character 10 bounces to one side as shown in FIG. 3.

It is intended to cover by the appended claims all the embodiments that fall within the true spirit and scope of the invention.

The invention claimed is:

1. A toy character comprising a body portion having a leg assembly and a spring tail portion connected to said leg assembly, a motor secured to said body portion, a switch operated powered motor controller means for operating said motor, a gear train driven by said motor, a gear rack secured to said leg assembly, means including springs for movably mounting said leg assembly relative to said body portion, said gear train including a drive pinion having a partial tooth portion for engagement and disengagement with said rack whereby when the pinion is in engagement with the rack the legs will move downward against the action of the springs and when moved out of engagement with the rack the character will be moved upward by the spring tail.

2. A toy character as set forth in claim 1 in which the spring tail portion is in the form of a coiled spring.

3. A toy character as set forth in claim 2 in which the leg assembly includes two legs and means for connecting the spring tail to one of said legs.

4. A toy character as set forth in claim 3 in which the means for movably connecting at least one of said legs to said body portion includes a slot defined by one of said legs and a fastener means extending through said slot into said body whereby the leg assembly can move relative to said body portion.

5. A toy character as set forth in claim 4 in which there is a compression spring in said slot acting against the fastener means whereby when the legs are free to move in an upward direction the spring in said slot will aid in said movement.

6. A toy character as set forth in claim 4 in which there is an extension spring interconnecting the leg assembly and said body portion whereby when the leg assembly is free to move upward the extension spring will aid in said movement.

7. A toy character comprising a body portion having a pair of legs, a spring tail connected to one of said legs, means connecting said legs together, means for movably mounting the legs relative to said body portion, a motor secured to said body portion, a switch operated powered motor controller means for operating said motor, a gear train driven by said motor, a gear rack secured to one of said legs, said gear train including a drive pinion having a partial tooth portion for engagement and disengagement with said rack whereby when the pinion is in engagement with the rack the legs will be moved downward against the action of the spring tail and when moved out of engagement with the rack the character will be moved upward by the spring tail.

8. A toy character as set forth in claim 7 in which the tail comprises a coil spring.

9. A toy character as set forth in claim 8 in which the means for movably connecting the legs relative to the body includes at least one of the legs defining a slot and fastener means extending through said slot into the body portion.

10. A toy character as set forth in claim 8 in which there is an extension spring interconnecting the legs and the body portion whereby when the legs are free to move upward the extension spring will aid in said movement.

11. A toy character as set forth in claim 8 in which there is located in said slot a compression spring acting against said fastener whereby during the downward action of said body the tail spring and the springs in said slot are compressed and when the rack is disengaged from said pinion the springs create the upward movement of said body portion.

12. A toy character as set forth in claim 11 in which each of said legs contain the slot and spring assembly to move the legs and body upward when the pinion is disengaged from said rack.

* * * * *